US007423510B2

(12) United States Patent
Ger et al.

(10) Patent No.: US 7,423,510 B2
(45) Date of Patent: Sep. 9, 2008

(54) TRANSFORMER WITH HIGH SUSTAIN VOLTAGE AND DRIVING DEVICE USING THE SAME FOR DRIVING LIGHT SOURCE MODULE

(75) Inventors: Chih-Chan Ger, Taipei Hsien (TW); Yu-Chi Tsai, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/615,942

(22) Filed: Dec. 23, 2006

(65) Prior Publication Data

US 2007/0285203 A1 Dec. 13, 2007

(30) Foreign Application Priority Data

Jun. 9, 2006 (TW) ..... 95120561

(51) Int. Cl.
*H01F 27/24* (2006.01)
*H01F 27/30* (2006.01)

(52) U.S. Cl. ..... 336/208; 336/212; 336/198

(58) Field of Classification Search ..... 336/212, 336/222, 208, 180, 182, 198, 192
See application file for complete search history.

(56) References Cited

U.S. PATENT DOCUMENTS

| | | | | |
|---|---|---|---|---|
| 6,812,916 | B2 * | 11/2004 | Hwang | 345/102 |
| 7,102,300 | B2 * | 9/2006 | Chieh et al. | 315/291 |
| 7,116,205 | B2 | 10/2006 | Hsueh et al. | |
| 2006/0125591 | A1 * | 6/2006 | Yang et al. | 336/208 |
| 2007/0262842 | A1 * | 11/2007 | Chan et al. | 336/170 |

* cited by examiner

*Primary Examiner*—Anh T Mai
(74) *Attorney, Agent, or Firm*—Wei Te Chung

(57) ABSTRACT

A transformer (10) with high sustain voltage includes a first bobbin (125), a second bobbin (126), a core assembly (127), and an insulating frame (128*a*). The first bobbin defines a first hollow therein. The second bobbin is coupled to the first bobbin, and defines a second hollow therein. The core assembly includes a first iron core (127*a*) partly received in the first hollow and a second iron core (127*b*) partly received in the second hollow. The insulating frame is disposed between the first bobbin and the second bobbin, for insulatively isolating at least one part of the first iron core from the second iron core.

19 Claims, 11 Drawing Sheets

TRANSFORMER WITH HIGH SUSTAIN VOLTAGE AND DRIVING DEVICE USING THE SAME FOR DRIVING LIGHT SOURCE MODULE

BACKGROUND OF THE INVENTION

1. Field of the Invention

The invention relates to transformers, and particularly to a transformer with high sustain voltage, and a driving device using the transformer for driving a light source module.

2. Description of Related Art

Conventionally, transformers are widely used in electronic devices, for converting a received voltage to another appropriate voltage used by the electronic device. Due to the demand for large-sized LCD panels being on the increase, voltage rating of the transformers for LCD panels needs to be increased.

FIG. 7 is a conventional transformer 70. The transformer 70 includes a bobbin 701, a primary winding support 702, a secondary winding support 703, and a core assembly 704. The bobbin 701 defines a hollow (not shown) therein, and one part of the core assembly 704 is received in the hollow to form a closed magnetic circuit. The primary winding support 702 is configured on one side of the bobbin 701, for winding a primary winding (not shown) thereon. The secondary winding support 703 is configured on the other side of the bobbin 701, for winding a secondary winding (not shown) thereon, and acts as a high voltage end of the transformer 70. A distance d1 is configured between the secondary winding and the core assembly 704, and a distance d2 is configured between the core assembly 704 and legs 705 of the transformer 70. The distances d1 and d2 help provide sustain voltage, but the design is complicated, and testing the transformer 70 takes too much time.

FIG. 8 is another conventional transformer 80. The conventional transformer 80 includes a bobbin 801, at least one primary winding support 802, at least one secondary winding support 803, and a core assembly 804. The core assembly 804 is made of high-impedance materials, such as Ni—Zn alloy. The transformer 80 achieves a fairly high sustain voltage. However, the Ni—Zn alloy is too expensive.

Therefore, a heretofore unaddressed need exists in the industry to overcome the aforementioned deficiencies and inadequacies.

SUMMARY OF THE INVENTION

In one aspect of the present invention, a transformer with high sustain voltage includes a first bobbin, a second bobbin, a core assembly, and an insulating frame. The first bobbin defines a first hollow therein. The second bobbin is coupled to the first bobbin, and defines a second hollow therein. The core assembly includes a first iron core partly received in the first hollow and a second iron core partly received in the second hollow. The insulating frame is disposed between the first bobbin and the second bobbin, for insulatively isolating at least one part of the first iron core from the second iron core.

In another aspect of the present invention, a transformer with high sustain voltage includes a bobbin, a core assembly, and an insulating apparatus. The bobbin defines a hollow therein. The insulating apparatus is integrally configured in the bobbin, and divides the hollow into two parts. The core assembly includes a first iron core and a second iron core respectively partly received in the two parts of the hollow. The insulating apparatus insulatively isolates the first iron core from the second iron core.

In another aspect of the present invention, a driving device for driving a light source module, includes a converter circuit, a driving circuit, a transformer circuit, and a PWM controller. The converter circuit is for converting a received power signal to a direct current (DC) signal. The driving circuit is connected to the converter circuit, for converting the DC signal to an alternating current (AC) signal. The transformer circuit is connected between the driving circuit and the light source module, for converting the AC signal to another AC signal to drive the light source module. The transformer circuit includes a transformer defining a primary winding and a secondary winding arranged next to the primary winding thereon. The primary winding of the transformer is around a part of a first coupling core, and the secondary winding of the transformer is around another part of a second coupling core. An insulating apparatus is disposed besides the first coupling core and the second coupling core so as to maintain spacing between the first coupling core and the second coupling core. The PWM controller is connected to the driving circuit, for controlling the AC signal output from the driving circuit.

Other advantages and novel features will become more apparent from the following detailed description when taken in conjunction with the accompanying drawings, in which:

DETAILED DESCRIPTION OF THE INVENTION

Figure 1A:
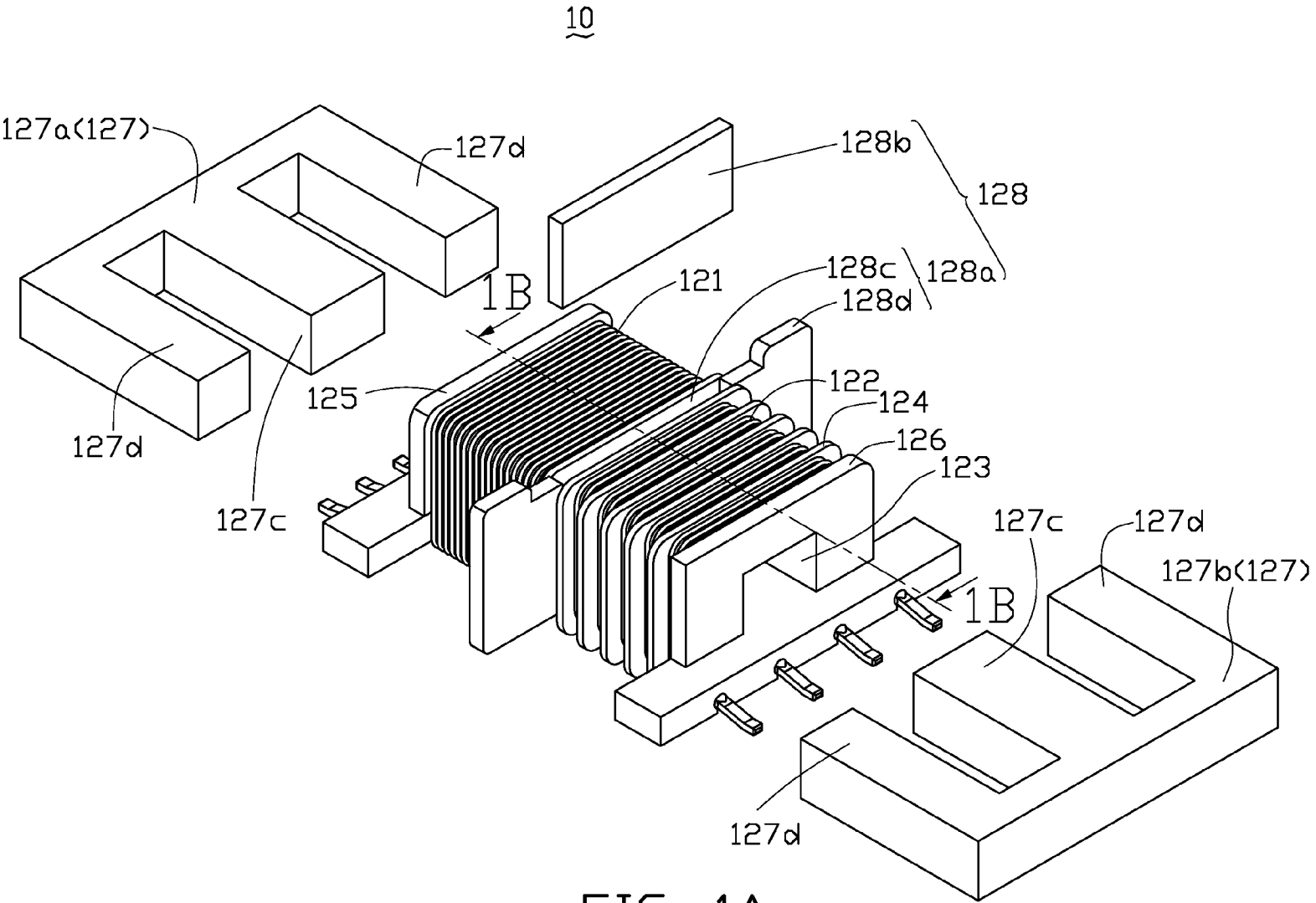
FIG. 1A is a transformer with high sustain voltage of a first embodiment of the present invention.
Figure 1B:
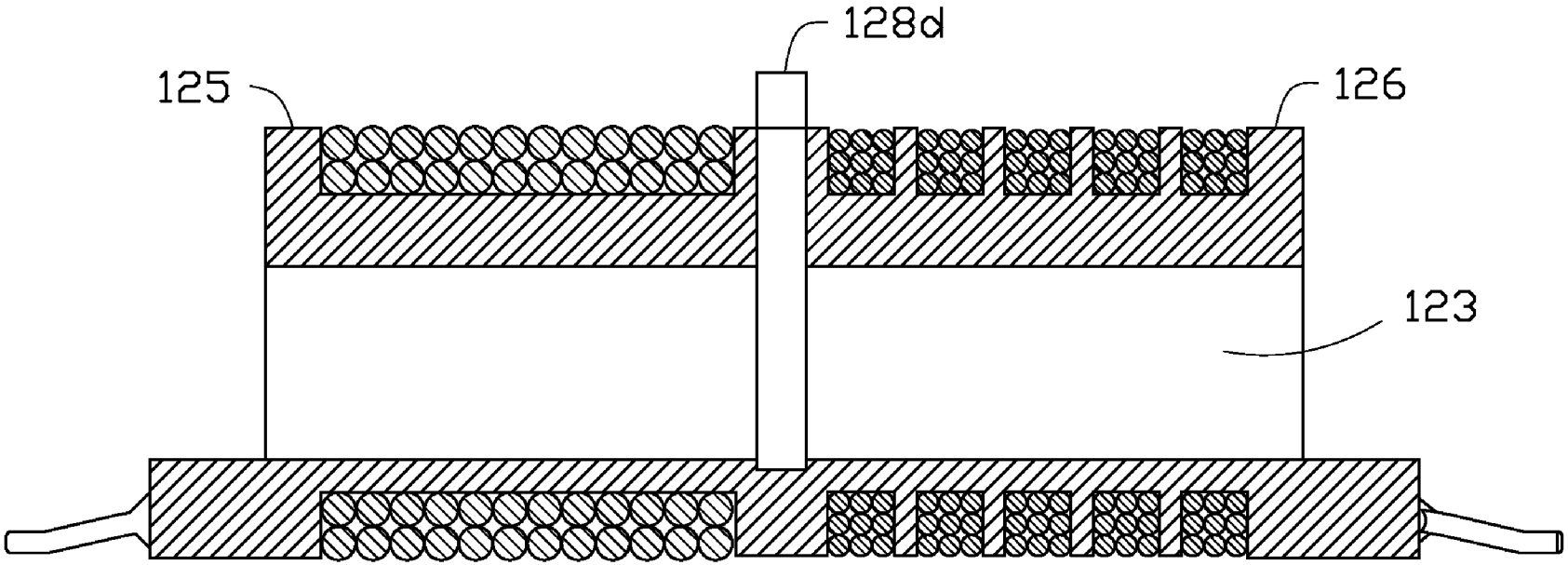
FIG. 1B is a side view along 1B-1B direction of FIG. 1A.

FIG. 1A is a transformer 10 with high sustain voltage according to an exemplary embodiment of the present invention, and FIG. 1B is a side view along 1B-1B direction of FIG. 1A. The transformer 10 includes a first bobbin 125, a second bobbin 126, a core assembly 127, and an insulating apparatus 128. The insulating apparatus 128 includes an insulating frame 128*a* and an insulating flake 128*b*.

The first bobbin 125 and the second bobbin 126 respectively define a hollow 123 therein for receiving one part of the core assembly 127. The first bobbin 125 is used for winding a primary winding 121 thereon. The second bobbin 126 is divided into a plurality of winding supports by a plurality of isolating walls 124, for winding a secondary winding 122 thereon. In the exemplary embodiment, a number of coils of the primary winding 121 is less than that of the secondary winding 122.

The core assembly 127 includes a first coupling iron core 127*a* adjacent to the first bobbin 125 and a second coupling iron core 127*b* adjacent to the second bobbin 126. The insulating apparatus 128 is disposed between the first iron core 127*a* and the second iron core 127*b*, for insulatively isolating the first iron core 127*a* from the second iron core 127*b*. The first iron core 127*a* and the second iron core 127*b* respectively include an inner arm 127*c* and at least one outer arm 127*d*. In the exemplary embodiment, the first iron core 127*a* and the second iron core 127*b* each include a pair of outer arms 127*d*. The outer arms 127*d* of the first iron core 127*a* and the outer arms 127*d* of the second iron core 127*b* are symmetrically disposed on two opposite sides of the insulating apparatus 128. The inner arm 127*c* of the first iron core 127*a* and the inner arm 127*c* of the second iron core 127*b* are respectively received in the hollows 123, and the outer arms 127*d* of the first iron core 127*a* and the outer arms 127*d* of the second iron core 127*b* are disposed around the first bobbin 125 and the second bobbin 126. A closed magnetic circuit is formed between the first iron core 127*a* and the second iron core 127*b* via the insulating apparatus 128. In the exemplary embodiment, the first iron core 127*a* and the second iron core 127*b* are E shaped iron cores.

The insulating frame 128*a* is disposed between the first bobbin 125 and the second bobbin 126, and includes a groove 128*c* and at least one isolating wall 128*d*. In the exemplary embodiment, the insulating frame 128*a* includes a pair of isolating walls 128*d*, and the isolating walls 128*d* are symmetrically disposed on two opposite sides of the insulating frame 128*a*. The groove 128*c* is formed between the pair of isolating walls 128*d*, and communicates with the hollow 123. The insulating flake 128*b* is disposed in the groove 128*c* of the insulating apparatus 128, and between the inner arm 127*c* of the first iron core 127*a* and the inner arm 127*c* of the second iron core 127*b*, for insulatively isolating the two inner arms 127*c* of the first iron core 127*a* and the second iron core 127*b*. The isolating walls 128*d* protrude from the first bobbin 125 and the second bobbin 126, for insulatively isolating the outer arms 127*d* of the first iron core 127*a* and the outer arms 127*d* of the second iron core 127*b*. In the exemplary embodiment, the first bobbin 125, the second bobbin 126, and the insulating frame 128*a* are integrally formed.

In the exemplary embodiment, a width of the insulating apparatus 128 is larger than that of the first bobbin 125 and the second bobbin 126, and heights of the isolating walls 128*d* are larger than that of the core assembly 127, for increasing creepage distance of the transformer 10 to improve sustain voltage. The greater the thicknesses of the insulating flake 128*b* and the isolating walls 128*d* are, the greater the voltage rating of the transformer 10 are. In other exemplary embodiments, the heights of the isolating walls 128*d* are equal to that of the core assembly 127.

Figure 2A:
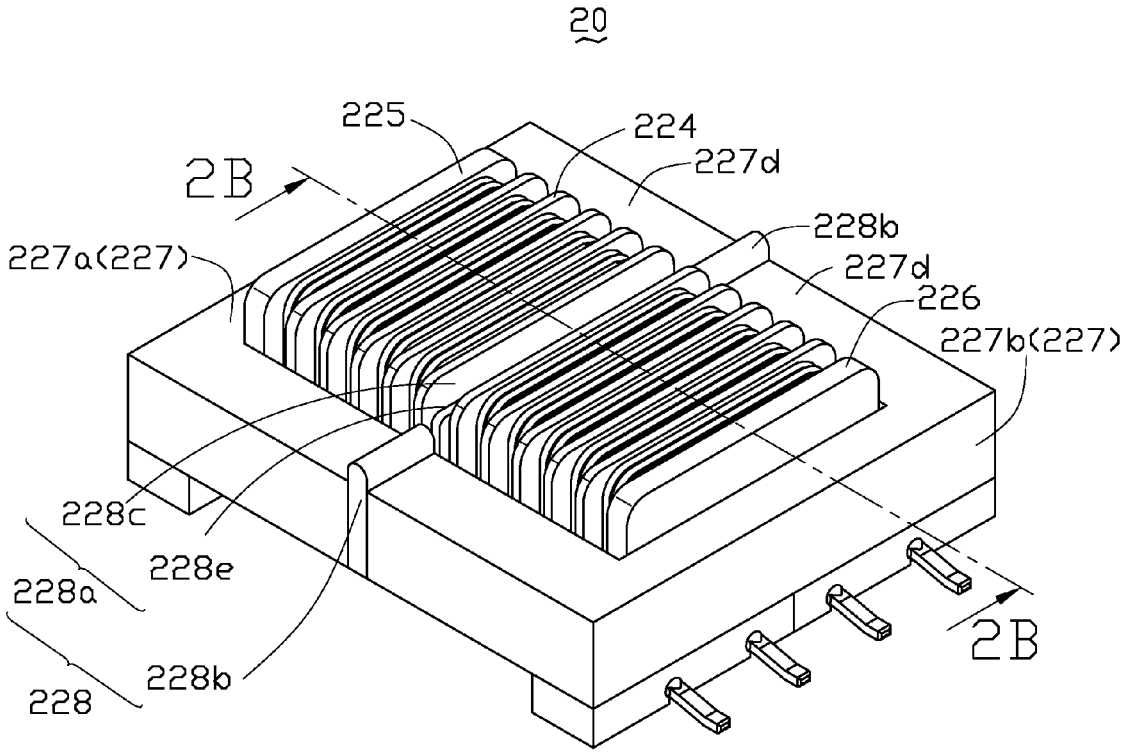
FIG. 2A is a transformer with high sustain voltage of a second embodiment of the present invention.
Figure 2B:
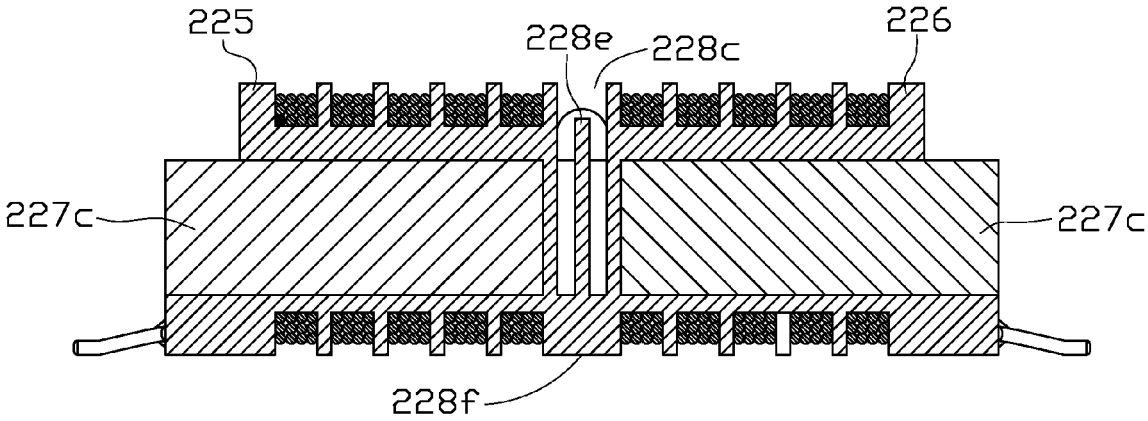
FIG. 2B is a side view along 2B-2B direction of FIG. 2A.

FIG. 2A is a transformer 20 with high sustain voltage according to another exemplary embodiment of the present invention, and FIG. 2B is a side view along 2B-2B direction of FIG. 2A. The transformer 20 is similar to the transformer 10 in FIG. 1A, except that a first bobbin 225 of FIG. 2A is divided into a plurality of winding supports by a plurality of isolating walls 224. An insulating frame 228*a* includes a bottom portion 228*f*, a groove 228*c*, and a protruding portion 228*e*. The groove 228*c* does not communicate with hollows (not shown) of the first bobbin 225 and hollows (not shown) of the second bobbin 226. The protruding portion 228*e* extends from a bottom portion 228*f* in the groove 228*c*, for increasing creepage distance of the transformer 20 to improve sustain voltage.

The insulating frame 228*a* is disposed between a first iron core 227*a* and a second iron core 227*b*, for insulatively isolating two inner arms 227*c* of the first iron core 227*a* and the second iron core 227*b*. In the exemplary embodiment, a pair of insulating flakes 228*b* are disposed on two opposite sides of the insulating frame 228*a*, and between outer arms 227*d* of the first iron core 227*a* and outer arms 227*d* of the second iron core 227*b*, for insulatively isolating the outer arms 227*d* of the first iron core 227*a* and the outer arms 227*d* of the second iron core 227*b*. In other exemplary embodiments, the insulating flakes 228*b* are eliminated, that is the outer arms 227*d* of the first iron core 227*a* and the outer arms 227*d* of the second iron core 227*b* are insulatively isolated by air.

In the exemplary embodiment, heights of the insulating flakes 228*b* are larger than that of the first iron core 227*a* and the second iron core 227*b*, for increasing creepage distance of the transformer 20 to improve sustain voltage. In other exemplary embodiments, the heights of the insulating flakes 228*b* may be equal to that of the first iron core 227*a* and the second iron core 227*b*.

In the exemplary embodiment, the insulating frame 228*a*, the first bobbin 225, and the second bobbin 226 are integrally formed. In other exemplary embodiments, the insulating frame 228*a*, the insulating flake 128*b*, the first bobbin 225, and the second bobbin 226 may be integrally formed.

In the exemplary embodiment, the transformer 20 is a choke. The winding is wound from the legs (not shown) of the transformer 20, and on the first bobbin 225 and the second bobbin 226; that is the first bobbin 225 and the second bobbin 226 are wound with the same wire.

Figure 3:
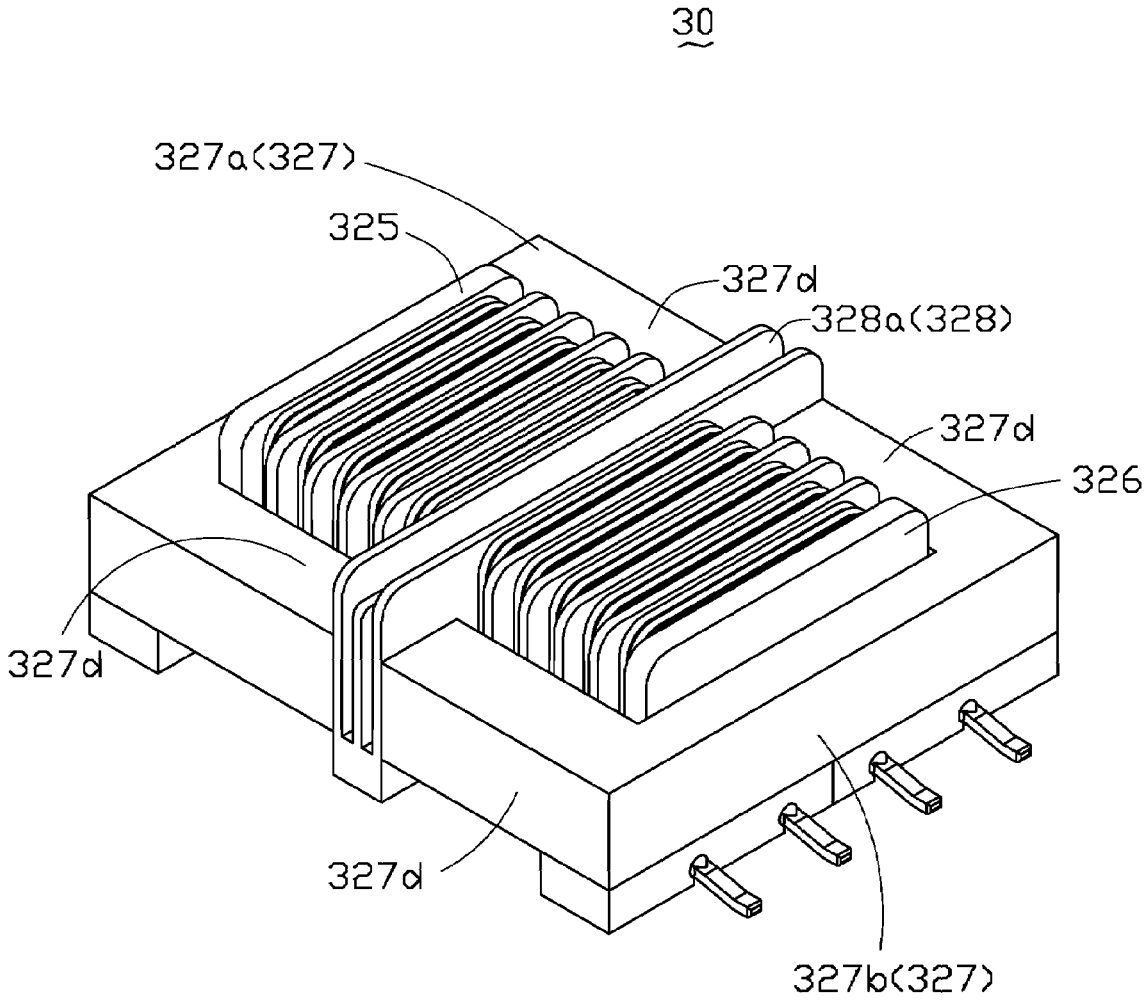
FIG. 3 is a transformer with high sustain voltage of a third embodiment of the present invention.

FIG. 3 is a transformer 30 with high sustain voltage according to a further exemplary embodiment of the present invention. The transformer 30 is similar to the transformer 20 in FIG. 2A, except that the insulating flakes of FIG. 2A are eliminated. The width of the insulating frame 328*a* is larger than that of the first bobbin 325 and the second bobbin 326, for insulatively isolating inner arms (not shown) and outer arms 327*d* of a first iron core 327*a* and a second iron core 327*b*. In the exemplary embodiment, the transformer 30 is a choke, and the insulating frame 328*a*, the first bobbin 325, and the second bobbin 326 are integrally formed.

Figure 4A:
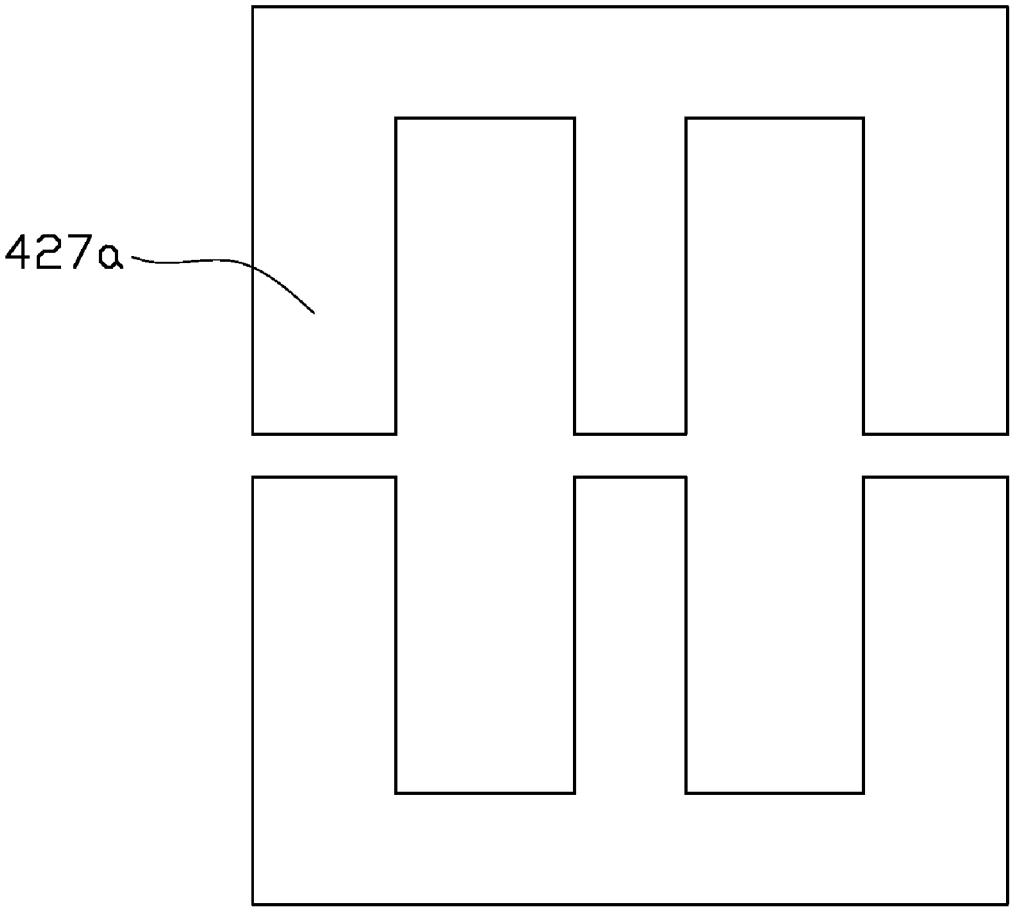
FIG. 4A is a schematic view of a core assembly of an exemplary embodiment used in any of the transformers of the first through third embodiments of the present invention.
Figure 4B:
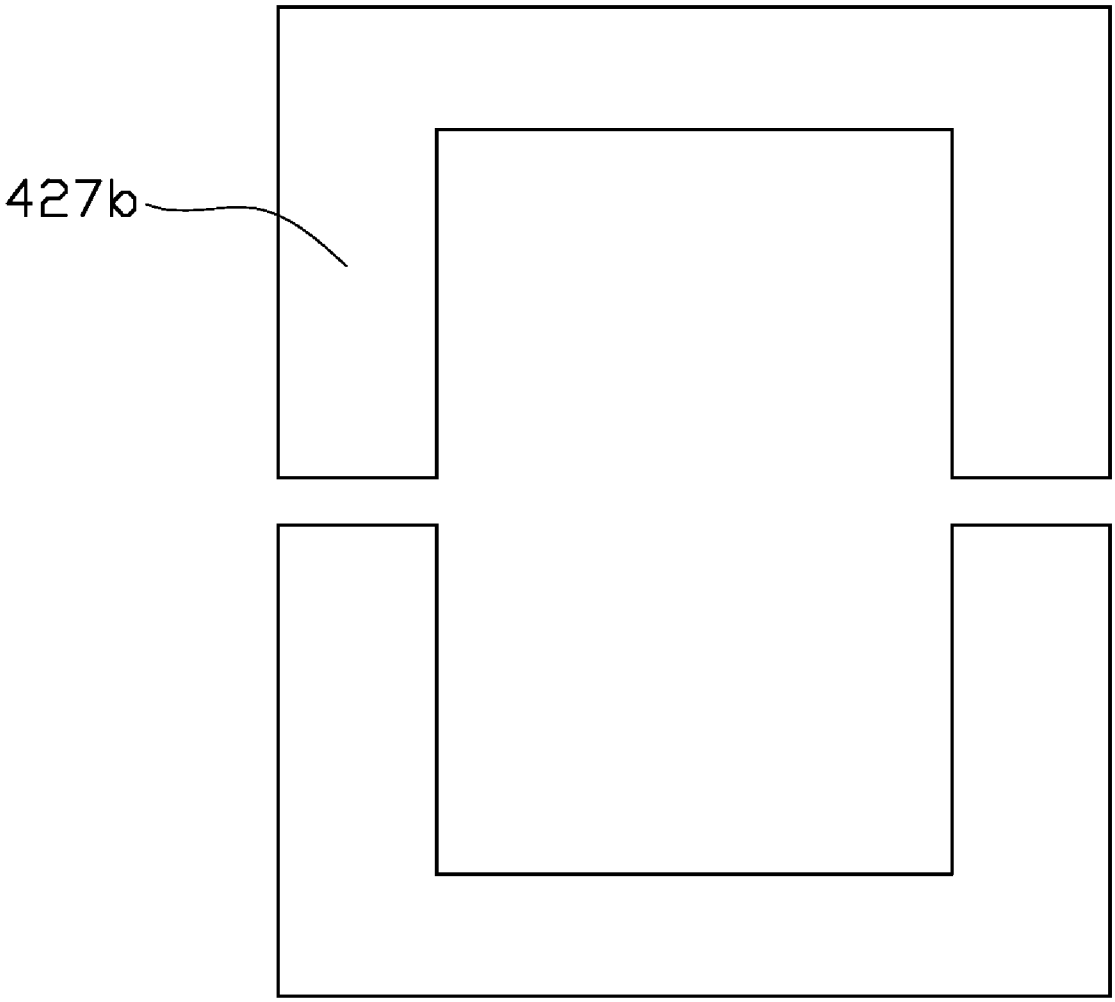
FIG. 4B is a schematic view of a core assembly of another exemplary embodiment used in any of the transformers of the first through third embodiments of the present invention.

FIG. 4A is a schematic view of a core assembly of an exemplary embodiment of the present invention used for the transformers 10, 20, 30. Referring to FIG. 4A, the core assembly 127, 227, 327 is assembled using a pair of E shaped iron cores 427*a* to form the closed magnetic circuit. The core assembly 127, 227, 327, in accordance with the present invention, can be assembled using a pair of U shaped iron cores 427*b* as depicted in FIG. 4B or other shapes as determined by need.

Figure 5:
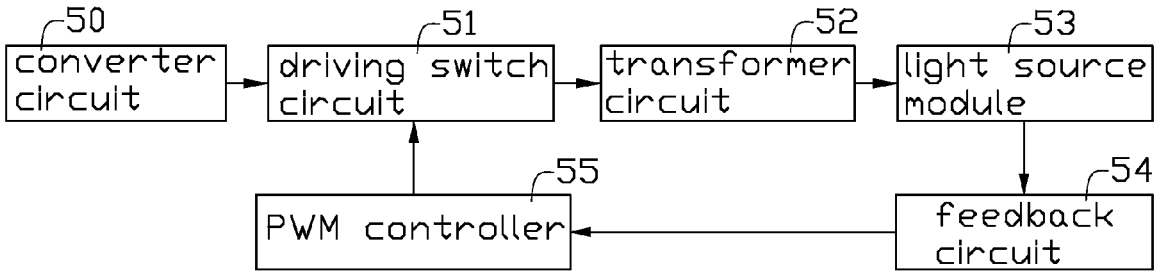
FIG. 5 is a block diagram of a driving device using any of the transformers of the first through third embodiment, for driving a light source module.

FIG. 5 is a block diagram of a driving device using the transformers 10, 20, 30 with high sustain voltage according to an exemplary embodiment of the present invention. The driving device includes a converter circuit 50, a driving circuit 51, a transformer circuit 52, a light source module 53, a feedback circuit 54, and a PWM controller 55. The driving device is for driving the light source module 53. The light source module 53 includes a plurality of light sources.

The converter circuit 50 converts a received power signal to a direct current (DC) signal. The driving circuit 51 is connected to the converter circuit 50, and is used for converting the DC signal to an alternating current (AC) signal. The transformer circuit 52 is connected between the driving circuit 51 and the light source module 53, for converting the AC signal to an appropriate AC signal to drive the light source module 53. In the exemplary embodiment, the AC signal output from the driving circuit 51 is a rectangular-wave signal, and the AC signal output from the transformer circuit 52 is a sine-wave signal. The feedback circuit 54 is connected between the light source module 53 and the PWM controller 55, for feeding back current flowing through the light source module 53 to the PWM controller 55. The PWM controller 55 is connected between the feedback circuit 54 and the driving circuit 51, for controlling the AC signal output from the driving circuit 51. The transformer circuit 52 shown in FIG. 5 includes one or more transformers with high sustain voltage as shown in FIG. 1A, FIG. 2A, or FIG. 3.

Figure 6:
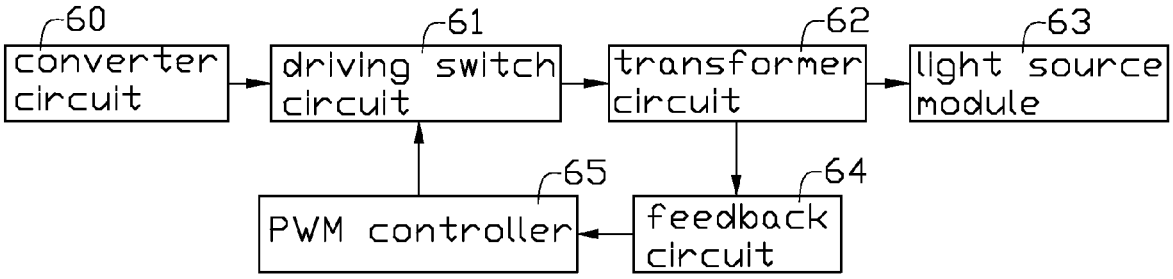
FIG. 6 is a block diagram of another driving device using any of the transformers of the first through third embodiment, for driving a light source module.
Figure 7:
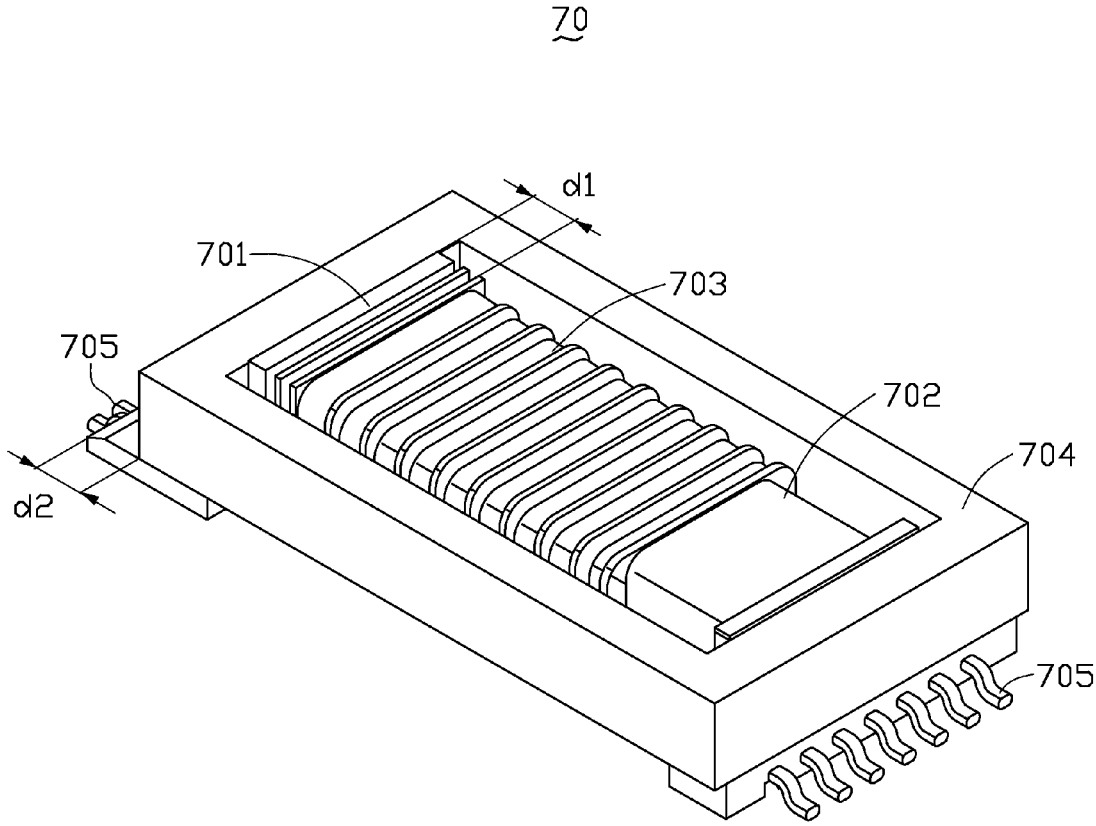
FIG. 7 (RELATED ART)
FIG. 7 is a conventional transformer.
Figure 8:
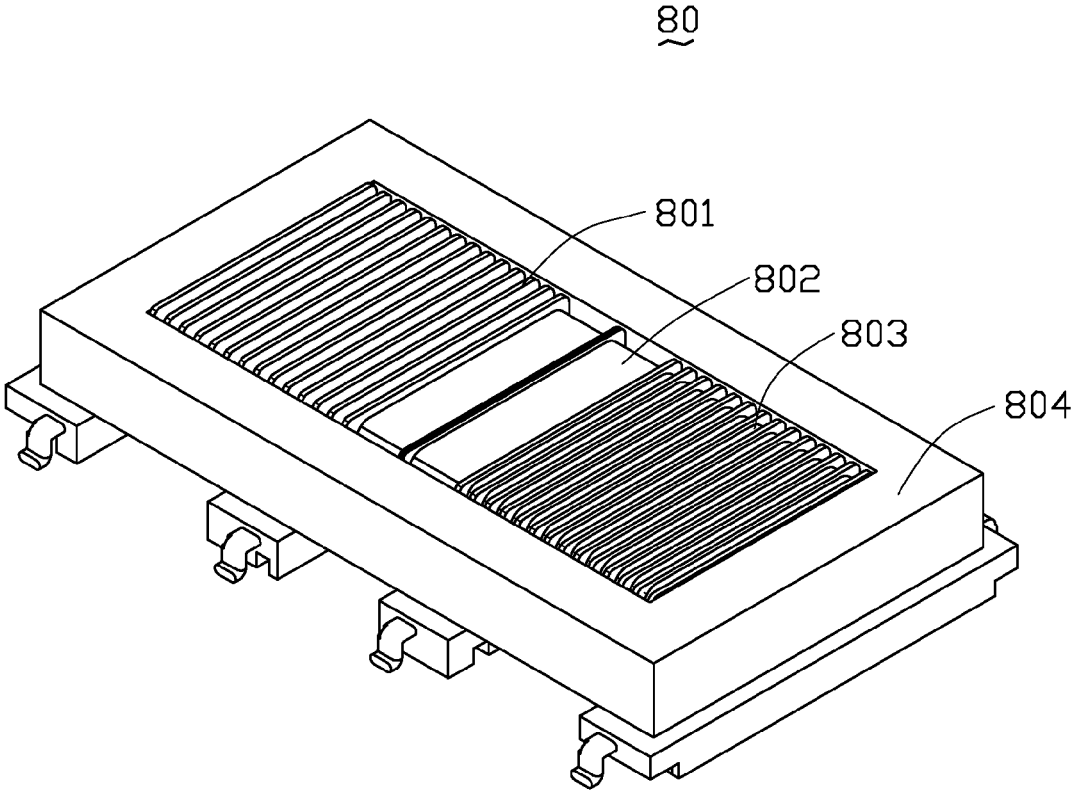
FIG. 8 (RELATED ART)
FIG. 8 is another conventional transformer.

FIG. 6 is a block diagram of a driving device using the transformer 10, 20, 30 with high sustain voltage according to another exemplary embodiment of the present invention. The driving device shown in FIG. 6 is substantially the same as that of FIG. 5, except that the feedback circuit 64 is connected between the transformer circuit 62 and the PWM controller 65, for feeding back current flowing through the light source module 63 to the PWM controller 65. The transformer circuit 62 shown in FIG. 6 includes one or more transformers with high sustain voltage as shown in FIG. 1A, FIG. 2A, or FIG. 3.

In the exemplary embodiment, the primary winding of the transformer 10 is connected to the driving circuit 51, 61, and the secondary winding of the transformer 10 is connected to the light source module 53, 63. When a voltage is provided to the primary winding, a magnetic field produced by current flowing through the primary winding cuts the secondary winding. Thus, a high voltage is generated in the secondary winding. A resonant circuit consists of a leakage inductance and exterior elements (not shown) of the transformer 10, for converting the high voltage to the appropriate AC signal to drive the light sources.

In the exemplary embodiment, the choke 20, 30 is connected between the secondary winding of the transformer 10 and the light source module 53, 63, for generating another high voltage to drive the light source module 53, 63.

In other exemplary embodiments, the transformer 10, 20, 30 with high sustain voltage can be connected between the driving circuit 51, 61 and the light source module 53, 63 in other ways.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A transformer with high sustain voltage, comprising:
- a first bobbin defining a first hollow therein;
- a second bobbin coupled to the first bobbin, and defining a second hollow therein;
- a core assembly, comprising a first iron core partly received in the first hollow and a second iron core partly received in the second hollow; and
- an insulating frame disposed between the first bobbin and the second bobbin, for insulatively isolating at least one part of the first iron core from the second iron core.

2. The transformer of claim 1, wherein the first bobbin, the second bobbin, and the insulating frame are integrally formed.

3. The transformer of claim 1, wherein at least one insulating flake is disposed between the first bobbin and the second bobbin, for insulatively isolating the other part of the first iron core from the second iron core.

4. The transformer of claim 3, wherein a groove is formed in the insulating frame between the first bobbin and the second bobbin, the insulating flake is disposed in the groove.

5. The transformer of claim 3, wherein a height of the insulating frame is greater than that of the first iron core and the second iron core.

6. The transformer of claim 3, wherein the first iron core and the second iron core each comprise an inner arm and at least one outer arm, the first hollow and the second hollow are respectively for receiving the inner arm of the first iron core and the inner arm of the second iron core, and the outer arms of the first iron core and the second iron core are disposed around the first bobbin and the second bobbin.

7. The transformer of claim 1, wherein the first bobbin is wound with a primary winding, the second bobbin is wound with a secondary winding, and the second bobbin is divided by a plurality of isolating walls.

8. A transformer with high sustain voltage, comprising:
- a bobbin defining a hollow therein;
- an insulating apparatus integrally configured in the bobbin, dividing the hollow into two parts; and
- a core assembly, comprising a first iron core and a second iron core respectively partly received in the two parts of the hollow,
- whereby the insulating apparatus insulatively isolates the first iron core from the second iron core.

9. The transformer of claim 8, wherein the insulating apparatus comprises an insulating frame disposed between and formed integrally with the first bobbin and the second bobbin, for insulatively isolating at least one part of the first iron core and the second iron core.

10. The transformer of claim 9, wherein further comprises at least one insulating flake disposed between the first bobbin and the second bobbin, for insulatively isolating the other part of the first iron core from the second iron core.

11. The transformer of claim 8, wherein a height of the insulating apparatus is greater than that of the first iron core and the second iron core.

12. A driving device for driving a light source module, comprising:
- a converter circuit for converting a received power signal to a direct current (DC) signal;
- a driving circuit connected to the converter circuit for converting the DC signal to an alternating current (AC) signal;
- a transformer circuit connected between the driving circuit and the light source module for converting the AC signal to another AC signal to drive the light source module, the transformer circuit comprising a transformer defining a primary winding and a secondary winding arranged next to the primary winding thereon, the primary winding of the transformer around a part of a first coupling core, and the secondary winding of the transformer around another part of a second coupling core, an insulating apparatus disposed besides the first coupling core and the second coupling core so as to maintain spacing between the first coupling core and the second coupling core; and
- a PWM controller connected to the driving circuit, for controlling the AC signal output from the driving circuit.

13. The driving device of claim 12, further comprising a first bobbin formed between the primary winding and the first coupling core, and a second bobbin formed between the secondary winding and the second coupling core.

14. The driving device of claim 12, further comprising a feedback circuit connected between the light source module and the PWM controller, for feeding back current flowing through the light source module.

15. The driving device of claim 12, further comprising a feedback circuit connected between the transformer circuit and the PWM controller, for feeding back current flowing through the light source module.

16. The driving device of claim 13, wherein the first bobbin, the second bobbin, and the insulating apparatus are integrally formed.

17. The driving device of claim 13, wherein the insulating apparatus comprises an insulating frame and at least one insulating flake independently disposed in the insulating frame between the first bobbin and the second bobbin.

18. The driving device of claim 17, wherein a groove is formed in the insulating frame between the first bobbin and the second bobbin, the insulating flake is disposed in the groove.

19. The driving device of claim 17, wherein a height of the insulating frame is greater than that of the first coupling core and the second coupling core.

* * * * *